United States Patent [19]

Albano

[11] 4,333,622

[45] Jun. 8, 1982

[54] KNOCKDOWN SPACER FOR BOOKSHELVES AND THE LIKE

[76] Inventor: Robert N. Albano, 1844 S. Butler Ave. #4, Los Angeles, Calif. 90025

[21] Appl. No.: 144,979

[22] Filed: Apr. 30, 1980

[51] Int. Cl.[3] ..... A47B 91/00; F16M 11/20

[52] U.S. Cl. ..... 248/188.8; 248/174

[58] Field of Search ..... 248/188.8, 174; 229/15

[56] References Cited

U.S. PATENT DOCUMENTS

| | | | |
|---|---|---|---|
| 3,606,230 | 9/1971 | Hargreaves | 248/174 X |
| 3,901,389 | 8/1975 | Belokin | 248/174 X |
| 3,951,730 | 4/1976 | Wennberg et al. | 248/174 X |
| 4,102,525 | 7/1978 | Albano | 248/174 X |

*Primary Examiner*—Wayne L. Shedd
*Attorney, Agent, or Firm*—Brown & Martin

[57] ABSTRACT

A knockdown spacer for bookshelves and the like which is made from a single elongated rectangular blank of sheet material, creased at spaced intervals to fold into an open ended box-like block with internal diagonal bracing walls. The outer walls of the box structure wrap around the diagonal braces and one end of the blank has a retaining flap which overlaps one of the walls and is secured by releasable fasteners. The blank can be made at minimum cost from corrugated cardboard, or the like, which can support heavy loads when formed and braced in the manner described.

3 Claims, 6 Drawing Figures

KNOCKDOWN SPACER FOR BOOKSHELVES AND THE LIKE

BACKGROUND OF THE INVENTION

Bookshelves are often assembled with concrete blocks, bricks and the like used as spacers and supports between shelves. This type of structure is popular for temporary shelf assemblies, but the blocks are heavy and inconvenient to move. However, collections of books can be very heavy and the supports for the shelves must be strong enough to hold considerable loads.

Hollow, internally braced supports have been used, one example being described in my U.S. Pat. No. 4,102,525, which is for a support made from panels of sheet material hinged together to form a hollow box with an inner cross brace. While this has been found satisfactory and capable of supporting heavy loads, a very low cost support of this type would be more desirable.

SUMMARY OF THE INVENTION

The spacer described herein is made from a single, elongated rectangular blank of sheet material, such as corrugated cardboard, which is creased at spaced intervals to facilitate folding into an open ended box complete with internal diagonal bracing walls. The outer walls of the support form a box of rectangular or square cross section, one end of the blank having a flap which overlaps a part of one wall and is retained by releasable fasteners, such as Velcro patches, to secure the complete structure.

If corrugated cardboard is used, the corrugation flutes extend vertically for maximum strength and to facilitate creasing. With diagonal bracing in both directions between the corners of the box, the resultant spacer is very rigid yet light in weight and very economical to produce.

The primary object of this invention, therefore, is to provide a new and improved knockdown spacer for bookshelves and the like.

Another object of this invention is to provide a bookshelf spacer which is made from a single piece of sheet material folded in a novel manner to produce a rigid structure.

A further object of this invention is to provide a bookshelf spacer which is secured in the assembled position by a single, readily accessible retaining element.

Other objects and advantages will be apparent in the following detailed description, taken in conjunction with the accompanying drawings, in which.

DESCRIPTION OF THE PREFERRED EMBODIMENTS

Figure 1:
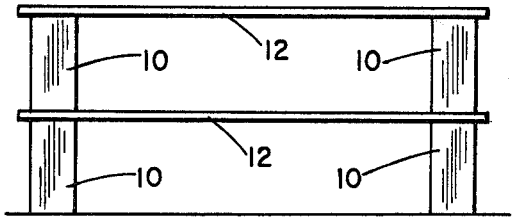
FIG. 1 illustrates a typical shelf assembly using four of the spacers.

The bookshelf assembly shown in FIG. 1 utilizes four spacers 10 to support two shelves 12. It will be obvious that any number of spacers and shelves can be assembled, within the limits of stability.

Figure 6:
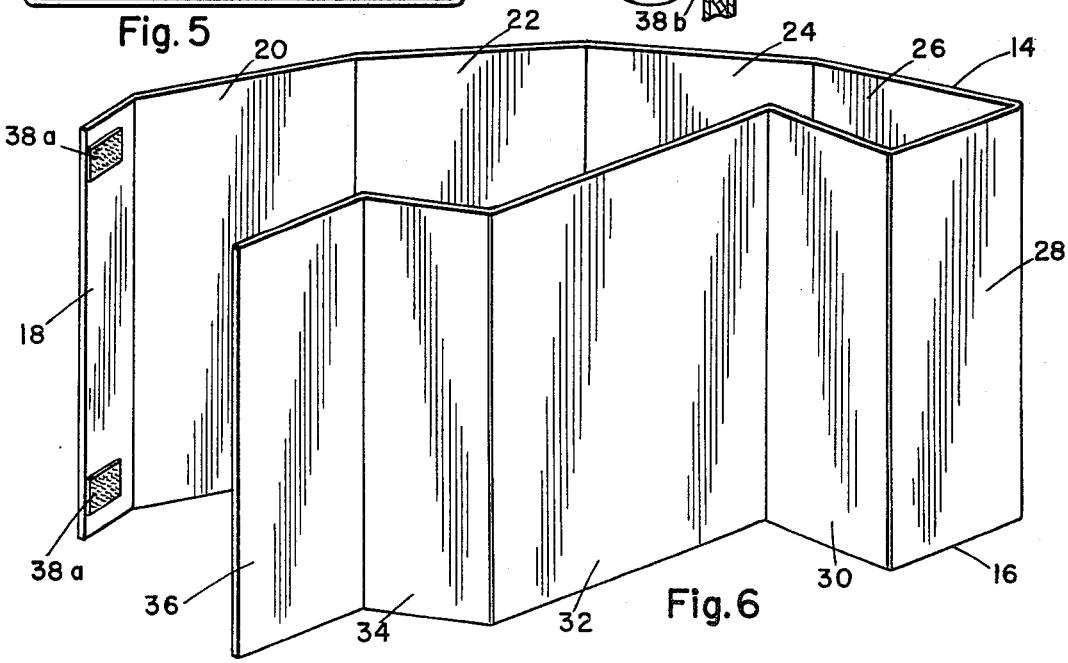
FIG. 6 is a perspective view of the unitary blank to illustrate the various panels and folds.

Each spacer 10 is made from a single rectangular blank of sheet material, as illustrated in FIG. 6, with creases extending perpendicularly between the opposite longitudinal edges 14 and 16 to divide the blank into multiple panels or walls. The blank is preferably made of corrugated cardboard with the flutes extending parallel to the creases, which facilitates creasing and also provides the maximum compressive strength in the assembled spacer. With reference to FIG. 6, the blank comprises, in succession, a retaining flap 18, four side walls 20, 22, 24 and 26, a pair of half diagonal walls 28 and 30, a full diagonal wall 32 and a final pair of half diagonal walls 34 and 36.

Figure 2:
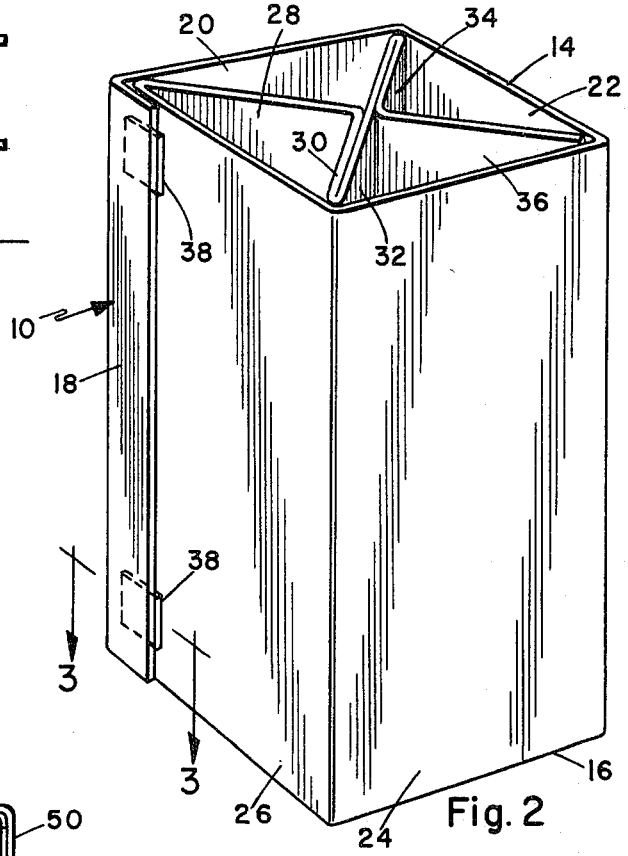
FIG. 2 is a perspective view of a single spacer.
Figure 4:
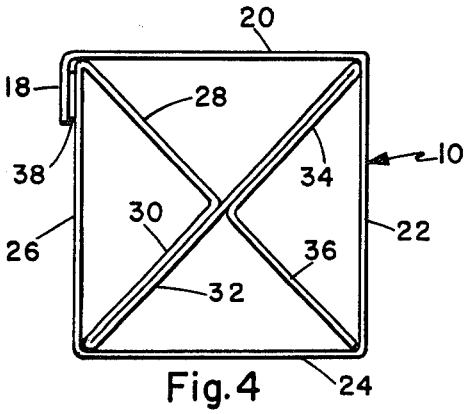
FIG. 4 is a top plan view of the spacer, showing a square cross section.

In the assembled condition, as shown in FIGS. 2 and 4, the side walls 20–26 form a square box, open at the top and bottom. Half diagonal walls 28 and 30 form a triangular channel with wall 26, full diagonal wall 32 is return folded against wall 30 and extends completely across the box between opposite corners, then half diagonal wall 34 is return folded against wall 32, so that walls 34 and 36 form a triangular channel with wall 22. The box is thus diagonally braced in both directions to form a very rigid structure.

The assembly is secured by retaining flap 18, which overlaps side wall 26 and is secured by suitable releasable fasteners. As illustrated the fasteners are in the form of Velcro patches 38, with one portion 38*a* of each attached to flap 18 and the other portion 38*b* to wall 26. Other fasteners of comparable type may be used in individual or strip form along the flap 18. When secured at this single location the spacer is an extremely rigid structure. With this spacer standing vertically on end and the edges 14 and 16 representing the upper and lower edges, the structure is capable of supporting very heavy loads under vertical compression without distortion.

Figure 5:
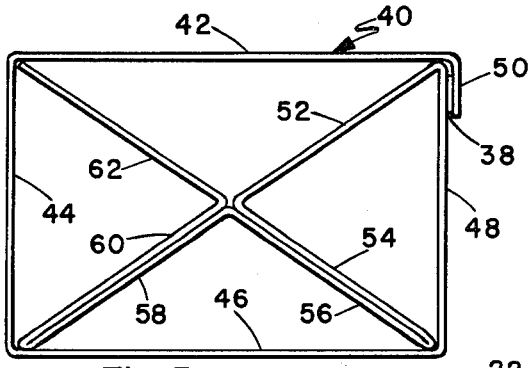
FIG. 5 is a top plan view of a spacer with a rectangular cross section and an alternative diagonal brace arrangement.
Figure 3:
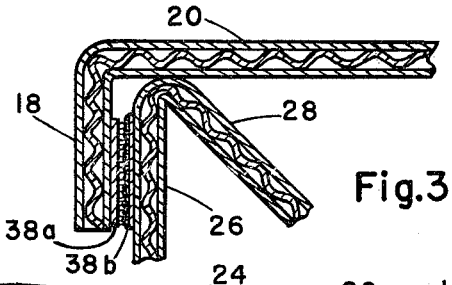
FIG. 3 is an enlarged sectional view taken on line 3—3 of FIG. 2.

If a larger cross section is required to support a wide shelf, the spacer can be made rectangular in cross section, as in FIG. 5. This rectangular spacer 40 has side walls 42, 44, 46 and 48, with an overlapping retaining flap 50 secured by fasteners 38. The internal bracing as shown differs from that of FIG. 4, in that no full diagonal wall is used. Instead, the continuation from wall 48 includes a first pair of half diagonal walls 52 and 54 forming a triangular channel with wall 48, a second pair of half diagonal walls 56 and 58 forming a triangular channel with wall 46 and a third pair of half diagonal walls 60 and 62 forming a triangular channel with wall 46 and a third pair of half diagonal walls 60 and 62 forming a triangular channel with wall 44. All of the half triangle walls are in succession in the basic blank, the walls 54 and 56 being return folded against each other and the walls 58 and 60 being similarly return folded. This arrangement also braces the box structure securely and provides a very rigid spacer.

It should be noted that either of the folding arrangements of the interior bracing walls can be used in either the square or rectangular spacers. As a further simplification, paper clips or similar forked fasteners could be inserted into the ends of the flutes at the retaining flap and the adjacent wall to secure the flap in place.

For moving or storage of the spacer the fasteners 38 are unfastened and the structure can then be unfolded to a flat condition. To minimize the flattened size the blank can be folded generally in half from the position illustrated in FIG. 6.

The spacer is thus a very serviceable yet economical to manufacture device, the only materials being a piece of corrugated cardboard and the fasteners. Any suitable coloring or decoration may be applied to the exterior of the side walls and retaining flap for decorative purposes.

Having described my invention, I now claim:

1. A knockdown spacer for bookshelves and the like, comprising:

a single piece elongated rectangular blank of flat sheet material having opposed longitudinal edges;

said blank having creases extending perpendicularly between said edges, the creases being spaced to divide the blank into a continuous succession of wall elements arranged to be folded and define an open ended box of generally rectangular cross section with exterior side walls and interior cruciform diagonal walls extending between opposite corners of the box;

a single end of said blank having a retaining flap thereon for overlapping a portion of one of said side walls in the box configuration;

and retaining means including fasteners having interengaging elements on said flap and the overlapped side wall portion.

2. The structure of claim 8, wherein said diagonal walls include pairs of half diagonal walls forming triangular channels with opposed side walls, and a full diagonal wall return folded against one wall of each of said pairs.

3. The structure of claim 8, wherein said diagonal walls include successive pairs of half diagonal walls, each pair forming a triangular channel with one wall of each pair being return folded against a wall of the next adjacent pair.

* * * * *